US006113213A

United States Patent [19]

Hosaka

[11] Patent Number: 6,113,213

[45] **Date of Patent: *Sep. 5, 2000**

[54] RECORDING APPARATUS INCLUDING IDENTIFIABLE RECORDING HEAD AND RECORDING HEAD HAVING IDENTIFIABLE FUNCTION

[75] Inventor: Ken Hosaka, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/767,786

[22] Filed: Dec. 17, 1996

[30] Foreign Application Priority Data

Dec. 20, 1995 [JP] Japan ..... 7-332067

[51] Int. Cl.[7] ..... B41J 2/00

[52] U.S. Cl. ..... 347/20

[58] Field of Search ..... 347/5, 20, 40, 347/47, 159, 162; 400/174, 175

[56] References Cited

U.S. PATENT DOCUMENTS

| | | | |
|---|---|---|---|
| 5,033,887 | 7/1991 | Bauerle | 400/175 |
| 5,049,898 | 9/1991 | Arthur et al. . | |
| 5,289,210 | 2/1994 | Takayanagi | 347/14 |
| 5,363,134 | 11/1994 | Barbehenn | 347/49 |

FOREIGN PATENT DOCUMENTS

| | | |
|---|---|---|
| 0 374 762 | 6/1990 | European Pat. Off. . |
| 0 571 093 | 11/1993 | European Pat. Off. . |
| 0 626 266 | 11/1994 | European Pat. Off. . |
| 2-215551 | 8/1990 | Japan . |

*Primary Examiner*—N. Le
*Assistant Examiner*—Anh T. N. Vo
*Attorney, Agent, or Firm*—Fitzpatrick, Cella, Harper & Scitno

[57] ABSTRACT

In order to provide a recording apparatus having higher reliability with a low cost and simple construction, a rank heater representative of the characteristics of the recording head is provided, the driving condition therefor is established based on the resistance value of the rank heater, any erroneous mounting of the head is detected by the resistance value, and the recording control is modified by identifying the type of the mounted head. The resistance range exhibited by the rank heater is set different according to the type of the head, so that the different recording heads would not exhibit the same resistance value as each other. The resistance value is detected at the side of the apparatus, being detected whether the recording head is suited for the apparatus. In an apparatus in which a plurality of types of interchangeable heads are used, the invention is effective not only for detection of the head type, but also for detection of characteristics of the recording head.

28 Claims, 6 Drawing Sheets

Step S1
MOUNT RECORDING HEAD 1a
Step S2
READ RESISTANCE "R" OF RANK HEATER 22
Step S3
R1≦R≦R2 ?
No
Step S7
DISABLE/ ERROR DISPLAY
Yes
Step S4
DECIDE RANK
Step S5
STORED DATA
Step S6
START PRINTING Step S11
MOUNT RECORDING HEAD 1b
Step S12
READ RESISTANCE "R" OF RANK HEATER 22
Step S13
R3≦R≦R4 ?
No
Step S17
DISABLE/ ERROR DISPLAY
Yes
Step S14
DECIDE RANK
Step S15
STORED DATA
Step S16
START PRINTING

RECORDING APPARATUS INCLUDING IDENTIFIABLE RECORDING HEAD AND RECORDING HEAD HAVING IDENTIFIABLE FUNCTION

BACKGROUND OF THE INVENTION

1. Field of the Invention

The present invention relates to a recording head for creating an image and to a recording apparatus.

More specifically, the invention relates to an ink jet recording head, and to an ink jet recording apparatus.

2. Brief Description of the Related Art

Recently, recording apparatuses having the type of ink jet recording have been widely used and are noticed as the instruments for producing digital images. The output apparatuses utilizing ink jet recording include printers, copying machines, word processors, and facsimile machines, which are widely used in offices or household uses.

For applications for the above instruments, a variety of improvements have been made, such as small-size of the recording apparatus, and miniaturization of the ink jet recording head (hereinafter, referred to "recording head"). In addition, in order to reduce the running costs, the improvement includes the design for increasing the capacity of ink in the ink tank for supplying ink to the recording head, and for the cartridge comprising a recording head together with an ink tank. Also, for purposes of improved image quality and high speed recording, the improvements include increase of the number of discharge nozzles, of drive frequency and improvement in ink materials.

Although various instruments using ink jet recording heads to produce images are widely used, these head cartridges are not always commonly used for every instrument. There are some of the recording apparatuses having recording heads, head cartridges, or ink tanks, which have similar configurations or substantially the same dimensions. This is one of the results of cost reduction by common use of component parts or production lines, for preventing cost increase caused by the increase of parts or new investments for new establishment of production lines. As a result, recording heads or head cartridges similar to each other or having substantially the same construction, even though their performance is different, are being designed. Therefore, some devices can be used in common, and the other are disabled or operate erroneously, even though these can be fitted.

For preventing such a malfunction or erroneous mounting of the head or ink tank, some measures are known. As such preventing means, identification ability is provided for heads, cartridges or ink tanks.

Conventionally, for ease of distinction between various recording heads, several methods have been taken, such as (I) providing an identifiable member such as having a projection which is distinguished by the side of the apparatus, or providing uninstallability depending on the difference of the configuration; or (II) providing a ROM in the recording head for writing the information in advance or afterwardly, which is read by a reading means equipped in the recording apparatus to ensure the printing, as disclosed in the U.S. Pat. No. 5,049,898.

However, the flow of parts on the production line is disturbed owing to the different configurations of the recording heads, and the cost increase is caused by installing the additional parts such as a RAM.

Alternatively, an addition of a recognition circuit in the heater board including a heating element for bubbling the ink is proposed. Particularly in the bubble jet recording method in which the thermal energy is applied on ink to produce ink bubbles, and the pressure of the produced bubbles is utilized to discharge the ink, a heater board on which a heating resistor or drive circuit is formed, thereby it is possible to provide a recognition circuit or a special resistor for recognition on the same heater board. Still, by independently providing electric resistors or a recognition circuit for recognition, the increase of circuit patterns, wirings or contact pads can prevent the small-sized construction, and the circuit within the apparatus is also complicated by the additional wirings, and the cost increase is inevitable.

SUMMARY OF THE INVENTION

In view of the above-described problems, the present invention has been made. Accordingly, an object of the invention is to provide an ink jet recording apparatus having a construction by which the recording head and a head cartridge mounted thereto are correctly identified without adding the circuit or increasing the number of wirings or contact pads.

A recording apparatus according to the invention is featured in that the apparatus, having a recording head including a heating element for generating thermal energy for recording operation for printing onto a recording medium, comprises: a resistor formed in the recording head, the resistor is similar to the heating element and the same characteristics as those of the heating element; detection means for detecting the characteristics of the resistor; identification means for identifying the recording head to be mounted based on the result of the identification; and control means for controlling the operation of the apparatus based on the result of the identification.

The detection means may be of the structure to identify whether the recording head is a recording head adequate for the recording apparatus.

The control means may be of the structure to control to prevent printing operation by the mounted recording head, when the mounted recording head is determined to be inadequate for the printing apparatus. Also, a display device may be included in the recording apparatus for displaying a predetermined information; wherein the control means controls the display means to display the status of an inadequate recording head being mounted, when the mounted recording head is determined to be inadequate for the printing apparatus.

Also, the control means may be of the structure to control the operation of the recording apparatus in accordance with the identified type of the recording head and the characteristics exhibited by the resistor.

The resistor may be formed within the recording head in the same production process as that of the heating element.

In addition, the recording head is provided with identifiable function and featured by including a heating element for generating thermal energy for recording operation, and comprising a resistor formed similarly to the heating element and with the same characteristics as those of the heating element, the resistance value of the resistor being detected by the recording apparatus to which the recording head is mounted, wherein the resistance range is not overlapped with any other resistance range of the resistor of the different type of recording heads.

In a preferred construction of the invention, the recording head may be of a type in which a plurality of discharge outlets are provided for discharging ink onto the recording medium for providing recording. The recording head of this type may supply thermal energy by means of the heating element to produce air bubbles and discharge the ink out of the discharge outlets.

According to the invention, the use of the rank heater, which indicates the rank in accordance with the characteristics of the recording head, provides two functions, including one for setting the drive pulse and the other for distinguishing the type of the mounted head.

According to the feature of the invention, the cost increase is prevented without adding any specific circuit and the small-sized heater board is achieved.

DETAILED DESCRIPTION OF THE PREFERRED EMBODIMENTS

The preferred embodiments of the invention are hereinafter described in detail.

EMBODIMENT 1

Figure 2:
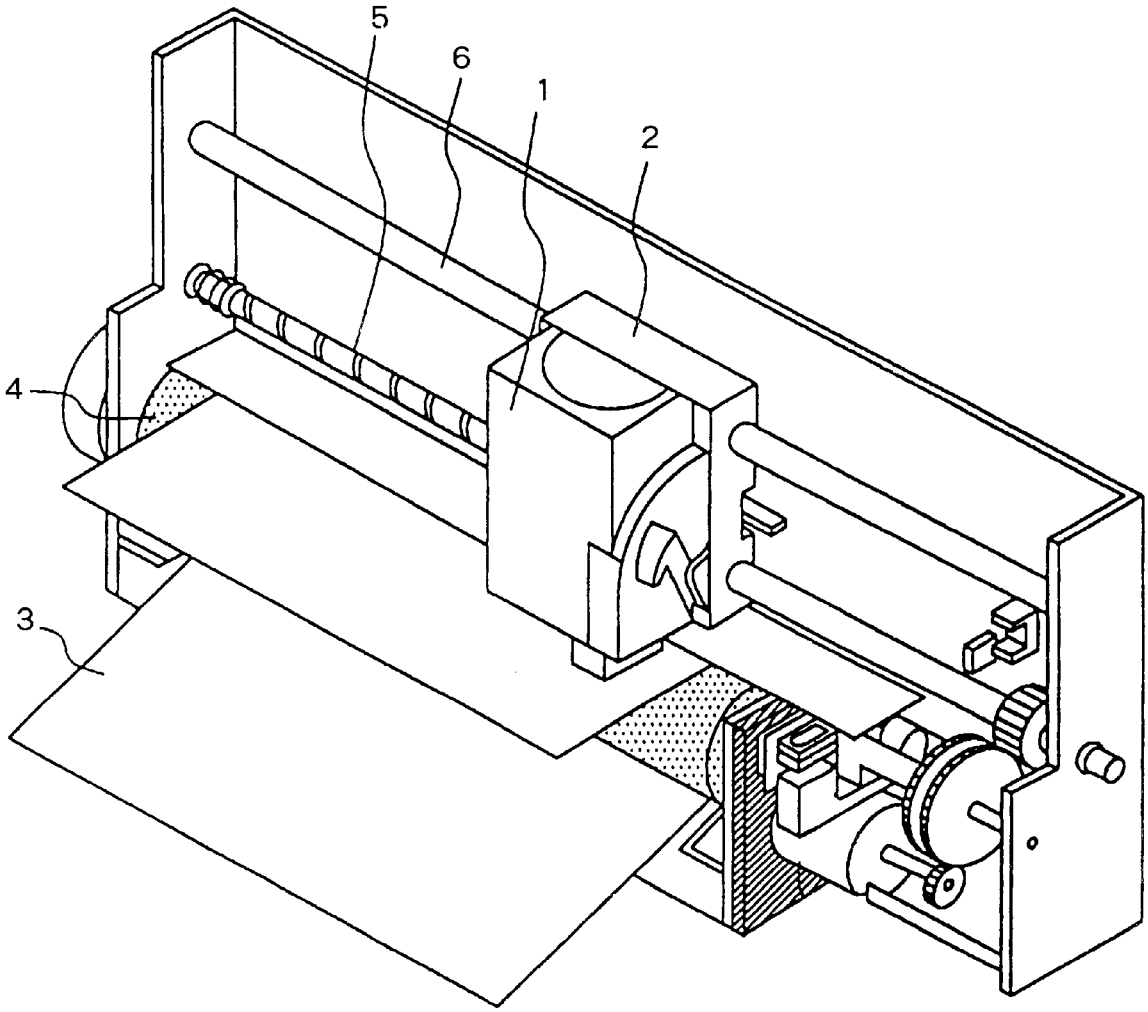
FIG. 2 is a perspective view of an ink jet recording apparatus according to the first embodiment.

FIG. 2 shows a summary view of the ink jet recording apparatus of the invention, in which a reference numeral 1 represents an ink jet recording head and a numeral 2 is a carriage for setting the recording head 1 on the apparatus to complete the electric connection between the apparatus and the head 1. The recording head 1 is moved in the main scanning direction together with carriage 2. A recording medium 3 such as a recording paper is fed in the direction perpendicular to the main scanning direction of the head 1 by means of a platen 4. Carriage 2 is slidably supported by two shafts 5 and 6, one of which is a threaded shaft 5 which is rotated to move the carriage 2.

Figure 3:
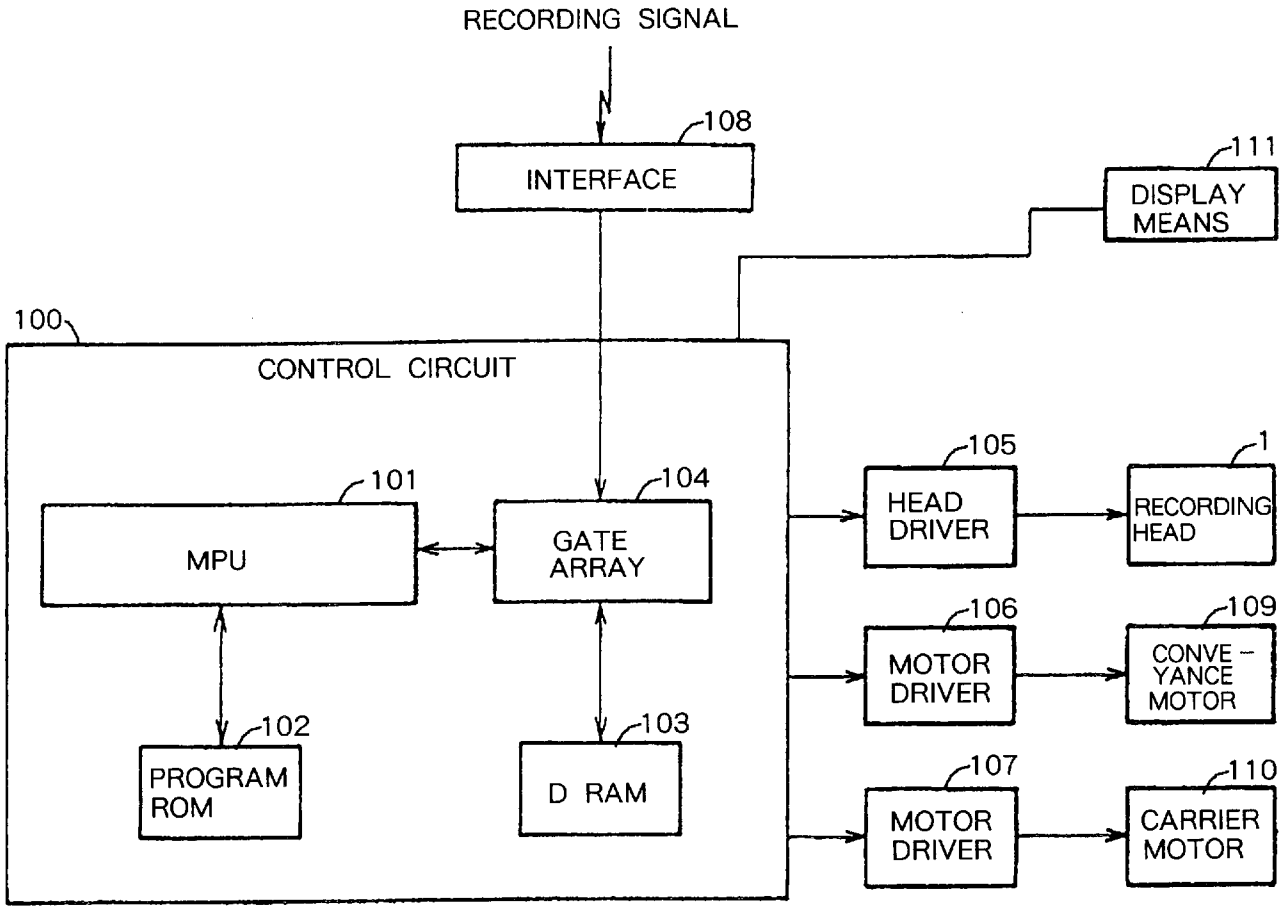
FIG. 3 is a block diagram of a control circuit included in the recording apparatus of FIG. 1.

FIG. 3 is a block diagram of the control circuit 100 for the ink jet recording apparatus, including an interface 108 for receiving a recording signal, an MPU 101, a ROM 102 for storing data and a control program to be executed, and a DRAM 103 for storing the recording signal above and various data including recording data. A gate array 104 controls supplement of recording data for recording head 1, and also controls data transfer between the interface 108, MPU 101 and RAM 103.

The apparatus further includes a carrier motor 110 for moving the carriage 2, a conveyance motor 109 for feeding the recording medium 3, a head driver 105 for driving the ink jet recording head 1, and motor drivers 106 and 107 for driving the conveyance motor 109 and carrier motor 110, respectively.

In operation of the control circuit 100, a recording signal applied to the interface 108 is converted to a recording data necessary for printing between gate array 104 and MPU 101. Then, when the motor drivers 106 and 107 are driven, the recording head 1 is driven in response to the recording data applied to head driver 105 to start printing. Control circuit 100 also controls the display device 111 for informing the status of the printer to the operator.

Figure 4:
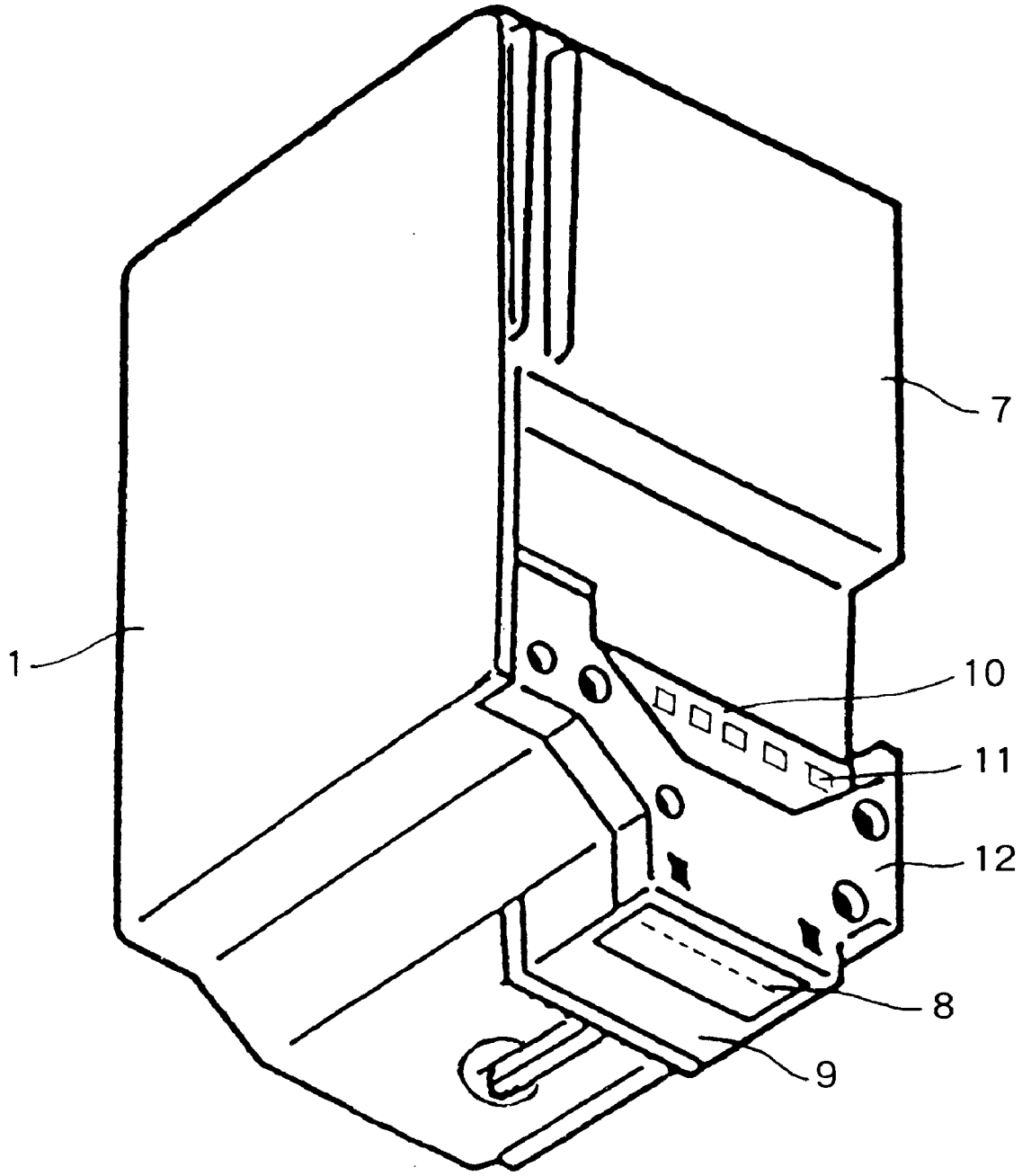
FIG. 4 is an enlarged perspective view of an ink jet recording head according to the first embodiment.

Then, the ink jet recording head 1 is described. FIG. 4 shows an example of a summary view, which includes an ink tank 7 for storing ink, ink discharge outlets 8, an ink supplying member 9, a printed wiring board (PWB) 10 connected to heating element (not shown), contact 11 pads to be electrically connected to the apparatus when mounted on carriage 2, and a base plate 12 for assembling the above components.

Figure 5:
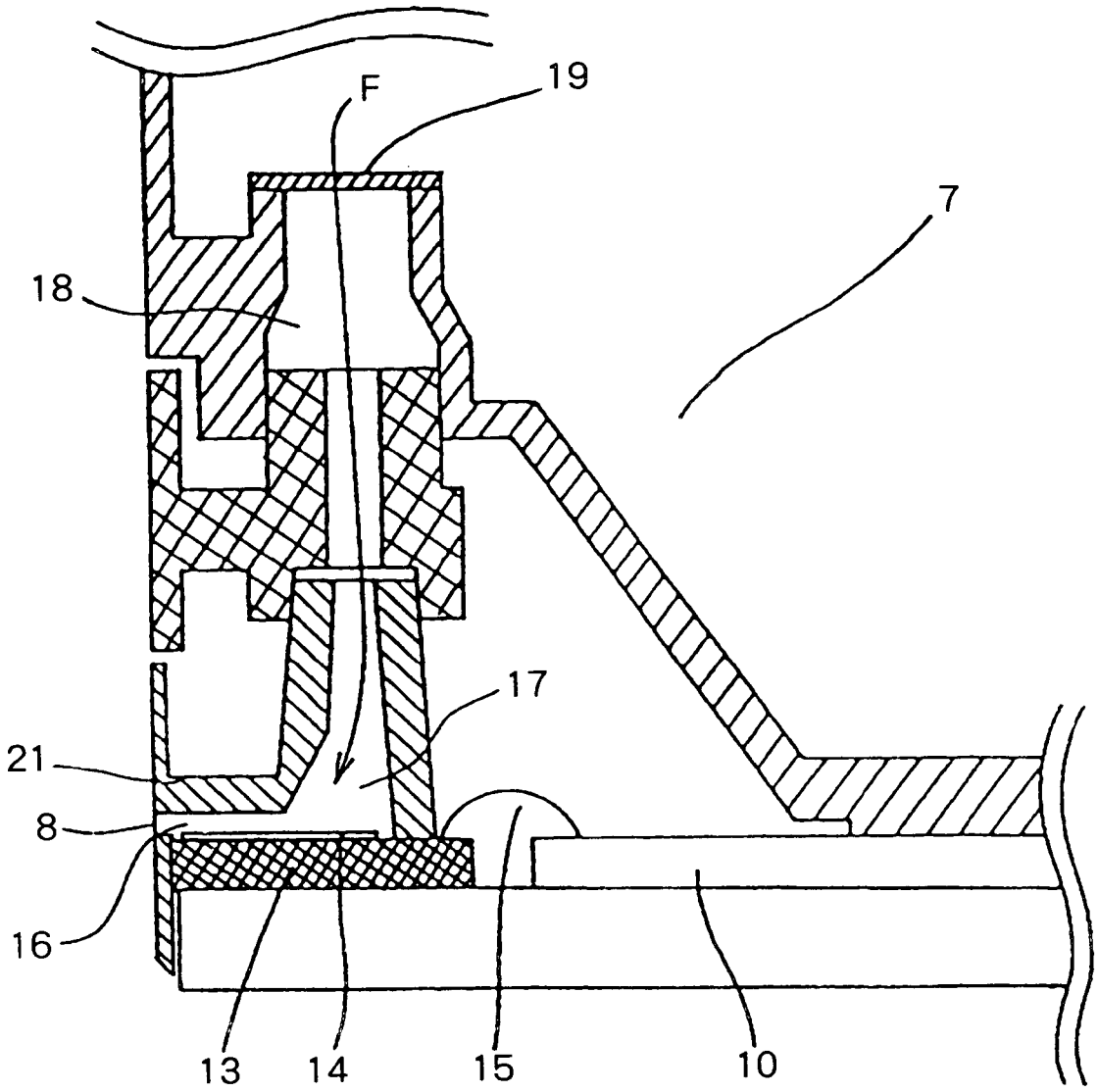
FIG. 5 is a partial sectional view illustrating the portion around the discharge outlet.

FIG. 5 shows an enlarged sectional view of the portion including the ink discharge outlet 8, in which a heating element 14 for discharging the bubbled ink is formed on a board 13 (hereinafter, referred to "heater board"), which is connected to PWB 10 and wires 15. A top board 21 is provided for forming therein a plurality of discharge outlets 8 and ink flow passages 16, and also for forming a communication chamber commonly communicating with the plurality of the passages 16.

An ink supply passage 18 is formed to communicate the interior of the ink tank 7 enclosing the ink with the common liquid chamber 17 within the recording head 1. A filter 19 is also provided for removing dust or dirt in the ink, and is attached to the side end of ink tank 7 of the ink supply passage 18, wherein the ink passage ranging from ink tank 7 to the discharge outlet formed by the top board 21 is shown by the arrow as illustrated through the supply passage 18 and common chamber 17.

Figure 6:
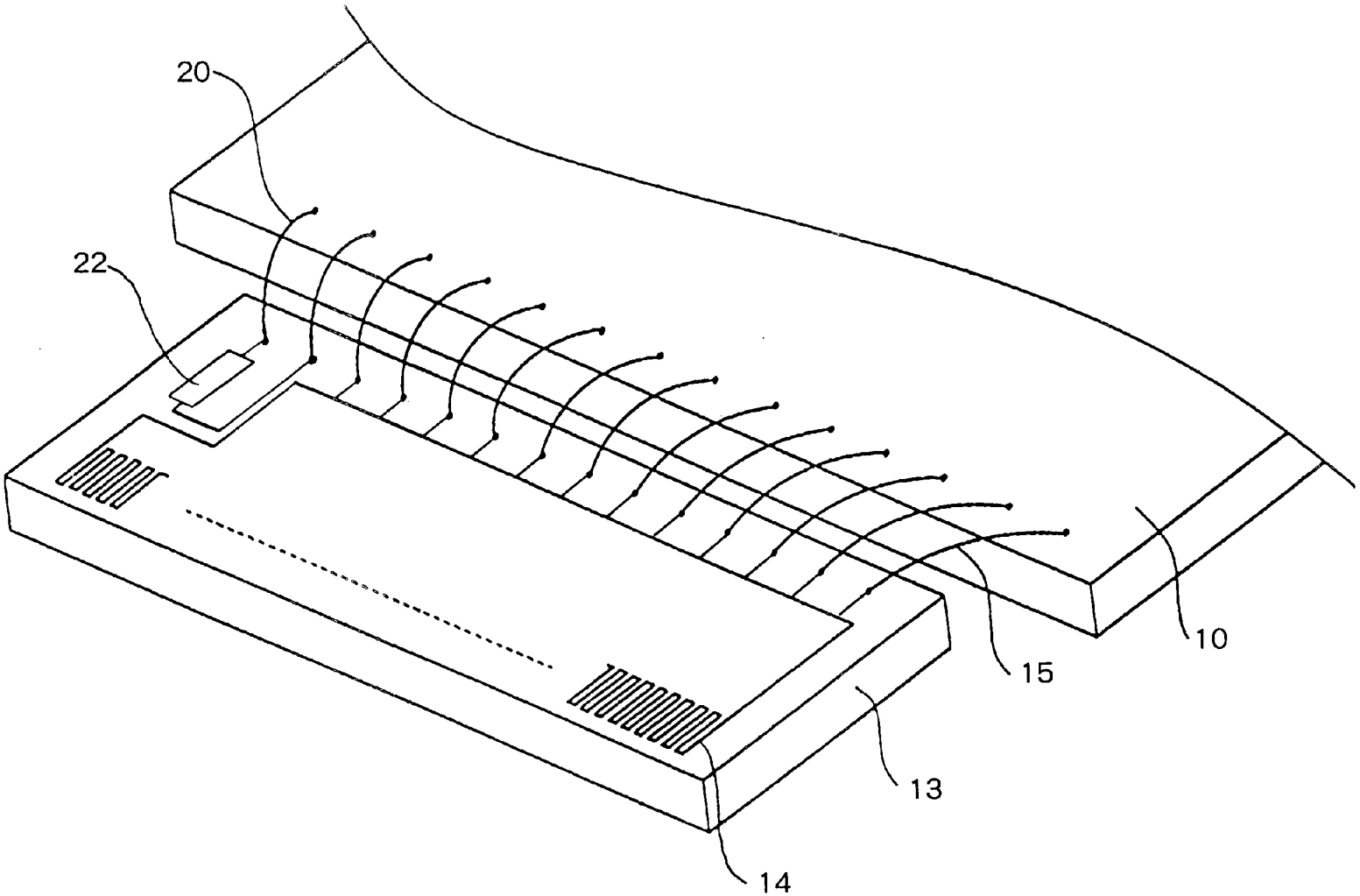
FIG. 6 is an enlarged perspective view of a heater board of the recording head according to the invention.

FIG. 6 is an enlarged perspective view of the heater board 13, in which the heating element 14 and wirings for connecting the element 14 are formed by repetition of film deposition by sputtering/vacuum evaporation and etching process. Further, there are illustrated a plurality of wire bondings 15 for connecting heating element 14 and PWB 10, and wires 20 for connecting to rank heater 22.

Heating element 14 for heating the ink is formed by repetition of film forming and etching, wherein the dispersion of resistance values of heating element 14 is inevitably caused owing to variation of film thickness in the course of production, or variation of etching dimension in the etching process. As a result, even though the same voltage is applied, the quantity of generated heat for causing bubbling is varied and the discharged amount becomes indefinite.

In order to provide a stable heating regardless of dispersion of resistance value, there are known some structures, comprising rank heater having characteristics modelled to the dispersion the resistance value.

The rank heater 22, formed on the heater board 13, is affected by the variation of the result of film forming or etching to the same extent as affected by that in heating element 14. Although the rank heater 22 is different in configuration, this is also formed in the same step of forming heating element 14. By detecting the resistance value of the rank heater 22, it is possible to estimate the variation of the resistance value of the heating element 14. Based on the detected resistance value of rank heater 22, the time for applying voltage to the heating element 14 is controlled. Thus, the heat generation is maintained in substantially a constant value to stabilize the ink discharge amount.

Since the purpose of the rank heater 22 is not ejecting the ink by such heating, these can be designed in a dimension in its length or width according to the desired resistance value within the range of a limited space to establish a predetermined resistance value of rank heater 22.

Utilizing the freedom of establishing the resistance value of the rank heater 22, the dispersion range of such resistance value is set to be different from each other and not to be overlapped to any other range of the different types of the recording heads 1. In such a manner, the rank heater 22 is utilized to distinguish the type of recording heads.

The sequence of operation in FIG. 1 is described referring to the Table 1, representing the rank division in accordance with the resistance value of rank heater 22: Table 1(a) shows the rank division for the recording apparatus A, and Table 1(b) for the apparatus B having discharge characteristics in discharge quantity, number of nozzles and drive frequencies different from the apparatus A, where the apparatus as A and B utilize a different type of the recording head from each other.

TABLE 1

RANK DIVISION IN ACCORDANCE WITH RESISTANCE VALUE

| Table 1(a) | | Table 1(b) | |
|---|---|---|---|
| Resistance of Rank Heater R | Rank Number | Resistance of Rank Heater R | Rank Number |
| $R_1 \leqq R \leqq r_1$ | 1 | $R_3 \leqq R \leqq q_1$ | 1 |
| $r_1 \leqq R \leqq r_2$ | 2 | $q_1 \leqq R \leqq q_2$ | 2 |
| . | 3 | . | 3 |
| . | . | . | . |
| . | . | . | . |
| $r_{(n-2)} \leqq R \leqq r_{(n-1)}$ | n − 1 | $q_{(m-2)} \leqq R \leqq q_{(m-1)}$ | m − 1 |
| $r_{(n-1)} \leqq R \leqq R_2$ | n | $q_{(m-1)} \leqq R \leqq R_4$ | m |

In Table 1(a), $R_1$ and $R_2$ are the lowest and highest limits of resistance, respectively, the range of which from $R_1$ to $R_2$ is divided in n parts. In Table 1(b), $R_3$ and $R_4$ are the lowest and highest limits of resistance, respectively, the range of which from $R_1$ to $R_2$ is divided in m parts.

The resistance R of the rank heater 22 for the apparatus A is in the range from the value equal to or larger than the lowest value $R_1$, and lower than or equal to the greatest value $R_2$. Similarly, the resistance R of the rank heater 22 for the apparatus B is in the range from the value equal to or larger than the lowest value $R_3$, and lower than or equal to the greatest value $R_4$. The relation thereof is such that either $R_2$ is lower than $R_3$, or $R_4$ is lower than $R_1$, hence the resistance ranges of apparatus A and B is designed not to be overlapped with each other.

The sequence of operation is now described with reference to FIG. 1.

A recording head 1*a* for apparatus A is mounted on the apparatus A in Step S1, and, in the subsequent Step S2, the resistance value R of the rank heater is read. When the read value R is determined to be included within the range from $R_1$ to $R_2$, the treatment is advanced to Step S4 and the rank number is selected on the basis of the rank table in Table 1(a). After the rank of the recording head is determined, the pulse width and other factors are decided, and, based on the recording data entered in Step S5, the printing operation is performed in Step S6.

Figures 1A, 1B:
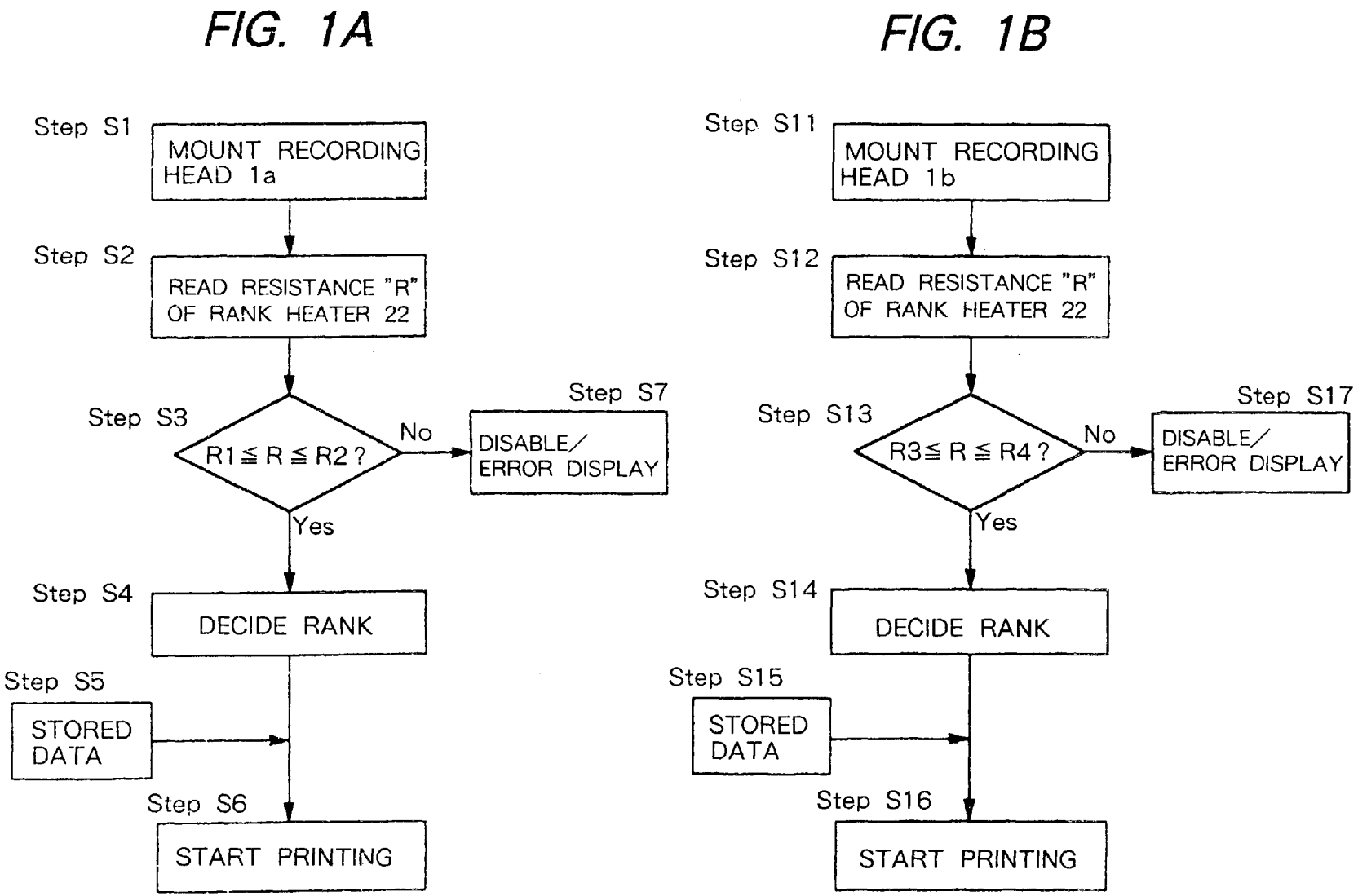
FIGS. 1A and 1B are flow charts showing the sequence of the present invention.

Similarly, when a recording head 1*b* for apparatus B is mounted on the apparatus B as shown in the flow chart of FIG. 1B, the rank number is selected from those in Table(b), and printing is performed.

In case that a recording head 1*a* is mounted on the apparatus B having the different discharge characteristics, since it is determined in Step S13 in the flow chart of FIG. 1B that any of the allowed values between $R_3$ and $R_4$ is not satisfied, the treatment is moved to Step S17, where the recording apparatus is disabled or such error state is displayed on the display device 111 in FIG. 3 to suspend the printing operation.

On the contrary, when a recording head 1*b* for apparatus B is mounted on the apparatus A, since it is determined that any of the values between $R_1$ and $R_2$ allowed for the apparatus A is not satisfied, the treatment is performed from Step S3 to S4 in the flow chart of FIG. 1A, where the recording apparatus is disabled or such error state is displayed on the display device 111 in FIG. 3 to suspend the printing operation.

The rank heater 22, having a simple and important structure providing an adequate bubbling condition for each head, may be added with an identification ability for different types of heads. As a result, a minimum construction for the recording head 1 is achieved without increasing the number of contact pads on the heater board 13 of the head 1 and without modifying the PWB 10 shown in FIGS. 4 and 5. Also in the printing apparatus, since the existing function or error display is performed with merely a minimum addition, a recording apparatus with a low cost and high reliability is provided.

EMBODIMENT 2

The second embodiment of the invention is hereinafter described.

Recently, for satisfying the demand on both the small-size and high performance of the recording apparatus, in order to perform the different functions of printing operation by a single recording apparatus, in some cases, a plurality of recording heads 1 are replaced on one carriage 2, where it is necessary that the recording heads are distinguished from each other to select the driving condition. The present invention is effective for providing such detecting means with a low cost in the recording heads and recording apparatus, and also effective for correctly identifying the recording head to achieve the printing with high reliability.

For example, a plurality of recording heads are interchangeably mounted, such as, one head for black printing only for performing high speed printing using the entire heads; another for three colors including yellow, magenta and cyan; and still another for four colors including said three colors and black. Also in such a printing apparatus for using interchangeable heads, by providing a rank heater for each of the above-mentioned recording heads in the range not overlapped on each other and identifying the resistance value thereof at the side of the recording apparatus, the selection of the driving condition for each head is enabled.

EMBODIMENT 3

Hereinafter described is the third embodiment of the invention.

In the case that the ink jet printing is applied to a large sized printer such as a plotter for printing on a medium over the A2 size for the purpose of design drawing, a high speed operation and an increased capacity for storing the ink are required. In such a case, instead of an integral color printing head including a plurality of colors, four separate heads each as an independent head for each color of black, yellow, magenta and cyan are preferably mounted on the printer.

In the above case, four separate ranges of resistance value of the rank heaters are provided for the four heads, respectively, so that any one range thereof is not overlapped with any of the other ranges, and also the corresponding four ranges for identification are provided in the side of the apparatus. In such a manner, the erroneous mounting among the heads is prevented.

What is claimed is:

1. A recording apparatus using a recording head including a heating element for generating thermal energy thereby performing a recording operation through printing onto a recording medium, comprising:

a mounting portion for mounting a recording head;

detection means for detecting a resistance value of a resistor formed in the recording head mounted on said mounting portion, said resistor being formed in a same production process as that of the heating element and said resistor having corresponding resistance characteristics to that of the heating element;

identification means for identifying whether the recording head mounted on said mounting portion is of a predetermined type based on a result of a determination as to whether a resistance value of the resistor detected by said detection means is within a range of predetermined resistance values;

determining means for determining a rank of the resistance value of the resistor in the recording head when identified by said identifying means as being of the predetermined type, based on the resistance value of the resistor detected by said detection means; and control means for controlling the recording operation in accordance with the rank of the resistance value within the range of predetermined resistance values determined by said determining means.

2. The recording apparatus according to claim 1, wherein said mounting portion mounts the recording head from among plural recording heads of different types and said plural recording heads of different types each including a resistor and a heating element having corresponding resistance characteristics, with each of the resistors having a different range of resistance values in accordance with type of recording head.

3. The recording apparatus according to claim 1, wherein said identification means identifies the type of the recording head based on the resistance value of said resistor of the recording head mounted on said mounting means.

4. The recording apparatus according to claim 1, wherein a recording head compatible with said recording apparatus and a recording head incompatible with said recording apparatus have resistors with different resistance values.

5. The recording apparatus according to claim 1, wherein resistance values of plural recording heads differ in accordance with types of the recording heads.

6. The recording apparatus according to claim 1, wherein said control means controls conditions under which the heating element of the recording head is driven.

7. The recording apparatus according to claim 1, wherein said identification means identifies whether said recording head is compatible with said recording apparatus.

8. The recording apparatus according to claim 7, wherein said control means prevents the printing operation by said recording head, when said recording head mounted on said mounting means is determined by said identification means to be incompatible with said recording apparatus.

9. The recording apparatus according to claim 7, further comprising a display device for displaying predetermined information, wherein said control means controls said display device to display the predetermined information when said recording head mounted on said mounting means is determined to be compatible with said recording apparatus.

10. The recording apparatus according to claim 1, wherein said identification means identifies the type of said recording head.

11. The recording apparatus according to claim 10, wherein said control means controls the recording operation in accordance with the type of said recording head identified by said identifying means and with the rank determined by said determining means.

12. The recording apparatus according to claim 1, wherein said recording head comprises a plurality of discharge outlets for discharging ink onto the recording medium.

13. The recording apparatus according to claim 12, wherein said heating element generates the thermal energy to produce bubbles in the ink to discharge the ink out of said discharge outlets.

14. A recording head including a heating element for generating thermal energy for a recording operation, comprising:

a resistor which is formed in a same production process as that of the heating element, and said resistor having corresponding resistance characteristics to that of the heating element, a resistance value of said resistor being detected by detecting means a recording apparatus to which said recording head is mounted, wherein a resistance value range of said resistor is not overlapped with resistance value ranges of resistors of different types of recording heads, which are mountable on the recording apparatus, and the resistance value of said resistor represents a type of said recording head and heating element characteristics of the heating element of said recording head, the heating element characteristics being represented by the resistance value within the range of resistance values corresponding to each of the recording heads.

15. The recording head according to claim 14, wherein the resistance value of said resistor indicates a rank in accordance with the heating element characteristics of the heating element.

16. The recording head according to claim 14, further comprising a plurality of discharge outlets for discharging ink onto a recording medium.

17. The recording head according to claim 16, wherein said heating element generates the thermal energy to produce bubbles to discharge the ink out of said discharge outlets.

18. A recording method for a recording apparatus having a mounting portion for mounting a recording head including a heating element for printing onto a recording medium by generating thermal energy, the mounting portion selectively mounting the recording head from among plural recording heads of different types, each of the recording heads of different types including a resistor, the resistor being formed in a same production process as that of the heating element and the resistor having corresponding resistance characteristics to that of the heating element, said method comprising the steps of:

detecting a resistance value of the resistor of the recording head mounted on the mounting portion;

determining whether the resistance value of the resistor detected in said detecting step is within a range of predetermined resistance values;

identifying whether the recording head mounted on the mounting portion is of a predetermined type based on a result of said determining step;

specifying a rank of the recording head, when identified as being of the predetermined type, in accordance with the resistance value of the resistor detected in said detecting step; and controlling the recording operation to perform printing in accordance with the rank of the resistance value within the range of predetermined resistance values specified in said specifying step.

19. The recording method according to claim 18, wherein of the plural recording heads, recording heads compatible with the recording apparatus and recording heads incompatible with the recording apparatus have resistors with different resistance values.

20. The recording method according to claim 18, wherein resistance values differ in accordance with the different types of the plural recording heads.

21. The recording method according to claim 18, wherein the recording operation is controlled in said controlling step as to conditions under which the heating element of the recording head is driven.

22. The recording method according to claim 18, wherein said identifying step identifies whether the recording head is compatible with the recording apparatus.

23. The recording method according to claim 22, wherein said controlling step prevents the printing operation by the recording head, when the recording head is determined to be incompatible with the recording apparatus.

24. The recording method according to claim 22, further comprising a step of displaying predetermined information, wherein said controlling step controls display of the predetermined information when the recording head is determined to be incompatible with the printing apparatus.

25. The recording method according to claim 18, wherein said identifying step identifies the type of the recording head.

26. The recording method according to claim 25, wherein said controlling step controls the recording operation in accordance with the type of the recording head identified in said identifying step and the resistance characteristics of the resistor.

27. The recording method according to claim 18, wherein the recording head comprises a plurality of discharge outlets for discharging ink onto the recording medium.

28. The recording method according to claim 27, wherein the heating element generates the thermal energy to produce bubbles in the ink to discharge the ink out of the discharge outlets.

* * * * *

UNITED STATES PATENT AND TRADEMARK OFFICE

CERTIFICATE OF CORRECTION

PATENT NO. : 6,113,213

DATED : September 5, 2000

INVENTOR(S) : HOSAKA

It is certified that error appears in the above-identified patent and that said Letters Patent is hereby corrected as shown below:

COLUMN 1:
Line 20, "small-size" should read --small size--.
Line 24, "ment includes" should read --ments include--.
Line 44, "other" should read --others--.
Line 58, "afterwardly," should read --afterwards,--.

COLUMN 2:
Line 64, "type" should read --types--.

COLUMN 4:
Line 9, "contact 11 pads" should read --contact pads 11--.

COLUMN 5:
Line 13, "apparatus as" should read --apparatuses--.
Line 35, "$R_1$ to $R_2$" should read --$R_3$ to $R_4$--.
Line 44, "apparatus" should read --apparatuses--, and "is" should read --are--.
Line 66, "is" should read --are--.

COLUMN 6:
Line 28, "small-size" should read --small size--.

UNITED STATES PATENT AND TRADEMARK OFFICE

CERTIFICATE OF CORRECTION

PATENT NO. : 6,113,213

DATED : September 5, 2000

INVENTOR(S) : HOSAKA

It is certified that error appears in the above-identified patent and that said Letters Patent is hereby corrected as shown below:

COLUMN 8:

Line 20, "means" should read --means of--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*